US006364691B1

(12) United States Patent
Hio

(10) Patent No.: US 6,364,691 B1
(45) Date of Patent: Apr. 2, 2002

(54) TERMINAL FITTING FOR FLAT CONDUCTOR

(75) Inventor: Masahide Hio, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/704,078

(22) Filed: Nov. 1, 2000

(30) Foreign Application Priority Data

Nov. 1, 1999 (JP) ..... 11-311502

(51) Int. Cl.[7] ..... H01R 4/24

(52) U.S. Cl. ..... 439/422

(58) Field of Search ..... 439/422, 421, 439/423, 424, 877

(56) References Cited

U.S. PATENT DOCUMENTS

| | | | | |
|---|---|---|---|---|
| 4,040,702 A | | 8/1977 | McKee et al. | 339/97 R |
| 4,082,402 A | | 4/1978 | Kinkaid et al. | 339/97 C |
| 4,834,673 A | * | 5/1989 | Beinhaur et al. | 439/422 |
| 5,299,954 A | * | 4/1994 | Ishii | 439/422 |
| 6,135,779 A | * | 10/2000 | Koch et al. | 439/422 |

FOREIGN PATENT DOCUMENTS

| | | |
|---|---|---|
| JP | 63-73861 | 5/1988 |
| JP | 63-73862 | 5/1988 |

* cited by examiner

*Primary Examiner*—Gary Paumen
*Assistant Examiner*—Ann McCamey
(74) *Attorney, Agent, or Firm*—Anthony J. Casella; Gerald E. Hespos

(57) ABSTRACT

A conductive path (11) is exposed on an upper surface of an FFC (10). At the rear end of the terminal fitting (20), a wavy bottom plate (22) and a wavy ceiling plate (23) confront each other such that the ceiling plate (23) can be opened and closed relative to the bottom plate (22). A piercing piece (35) whose front end is sharp is formed at the rear end of the ceiling plate (23) in about the half of the entire width of the rear end thereof by bending the piercing piece (35) perpendicularly. The terminal of the FFC 10 is sandwiched between the bottom plate (22) and the ceiling plate (23), and both crimping blades (26) are crimped to side edges of the ceiling plate (23). As a result, the conductive path (11) is bent wavily, the ceiling plate (23) contacts the conductive path (11), and the piercing piece (35) is pierced into the conductive path (11) and projects from the lower surface thereof. The FFC (10) is sandwiched the bottom plate (22) and the ceiling plate (23). The piercing piece (35) having a width in a direction perpendicular to a tensile force applied to the FFC (10) is pierced into the conductive path (11), thus providing a strong catching force and a holding force in resistance to the tensile force.

6 Claims, 10 Drawing Sheets

TERMINAL FITTING FOR FLAT CONDUCTOR

BACKGROUND OF THE INVENTION

1. Field of the Invention.

The present invention relates to a terminal fitting to be connected to a flat conductor.

2. Description of the Related Art.

Prior art flat conductors include an FFC (flexible flat cable) and an FPC (flexible print circuit board). The prior art FFC includes a plurality of parallel conductive paths sandwiched between insulation sheets. The FFC is flexible, and is formed in the shape of a ribbon. A terminal fitting can be connected to each conductive path of the FFC by tearing off the insulation sheet of the FFC and exposing the conductive paths on one surface of the FFC or by embedding the conductive paths in the insulation sheet.

The former method is disclosed in Japanese Patent Application Laid-Open No. 63-73862 and is shown in FIG. 12 herein. That is, as shown in FIG. 12, a predetermined amount of the insulation sheet 2 on the upper side of an FFC 1 is removed to expose a portion of a conductive path 3. FIG. 12 also shows a terminal fitting 4 with a connection part 5 to be connected with a mating terminal fitting. A bottom plate 6 extends rearwardly from the connection part 5, and a ceiling plate 7 that can be opened and closed is formed integrally with and in opposition to the bottom plate 6. Claws 8 are formed at the front end of the ceiling plate 7 and extend down from the respective side edges of the ceiling plate 7.

A disposing portion of the conductive path 3 is inserted between the bottom plate 6 and the ceiling plate 7, and the ceiling plate 7 then is rotated toward the bottom plate 6. As a result, the claws 8 are inserted into the rear surface of the FFC 1, and the claws 8 are crimped to both side edges of the bottom plate 6. Thus, the FFC 1 is sandwiched between the bottom plate 6 and the ceiling plate 8 and the ceiling plate 7 is pressed against the conductive path 3. In this manner, the terminal fitting 4 is connected to the terminal of the FFC 1.

The FFC 1 is used, with the terminal fitting 20 connected with the terminal of the FFC 1 and accommodated in a cavity of a connector housing (not shown). A rearwardly directed tensile force may be applied to the FFC 1. However, only the portion of the FFC 1 pierced by the claws 8 resists the tensile force, and the claws 8 are aligned parallel with the direction of the applied tensile force. Thus, there is a fear that the tensile force will tear the FFC 1 from the terminal fitting 4. Accordingly, there is a demand for an increase of a terminal fitting-holding force in resistance to a tensile force.

In the latter method, called a through type method, the terminal fitting is connected to the FFC by piercing the contact blade of the terminal fitting into the conductive path. In this method, there is also a demand for an increase of the terminal fitting-holding force in resistance to a tensile force.

The present invention has been completed in view of the above-described situation. Thus, it is an object of the present invention to provide a terminal fitting, for a flat conductor, having a high degree of a terminal fitting-holding force in resistance to a tensile force.

SUMMARY OF THE INVENTION

The subject invention is directed to a terminal fitting for a flat conductor, and particularly a terminal fitting that is to be connected to a flat conductor in which a conductive path is adjacent at least one insulation layer. The terminal fitting comprises a plurality of pressing plates. A bent piercing piece is formed at an end of at least one of the pressing plates and can be pierced into the conductive path of the flat conductor. The pressing plates are connected to each other, and are disposed to sandwich around upper and lower surfaces of a disposing position of the conductive path. At least one of the pressing plates is capable of contacting the conductive path.

The conductive path is exposed on a surface of the flat conductor; and one of the pressing plates that confronts the conductive path is pressed against the conductive path to bring the one pressing plate into contact with the conductive path.

A contact blade projects from one of the pressing plates, and is pierced into the conductive path to connect the terminal fitting to the terminal of the flat conductor.

When the flat conductor is sandwiched between both pressing plates, the piercing piece formed on the pressing plate pierces the conductive path, thus constituting a catching portion and providing a force for fixing the terminal fitting to the terminal of the flat conductor. In addition, the piercing piece contributes to the increase of the contact area between the terminal fitting and the conductive path. Thus, it is possible to enhance reliability of the electrical contact.

In the surface contact type of terminal fitting in which the pressing plate is brought into contact with the surface of the conductive path, it is possible to increase the holding force in resistance to a tensile force applied to the flat conductor and protect the contact surface. Therefore, it is possible to increase electrical reliability.

In the through type terminal fitting in which the contact blade is pierced into the conductive path to connect the terminal fitting to the terminal of the flat conductor, it is possible to increase the holding force in resistance to a tensile force applied to the flat conductor and protect the contact surface. Therefore, it is possible to increase electrical reliability.

DETAILED DESCRIPTION OF THE PREFERRED EMBODIMENTS

The first embodiment of the present invention, as illustrated in FIGS. 1 through 5, is directed to a surface contact type of terminal fitting.

Figure 1:
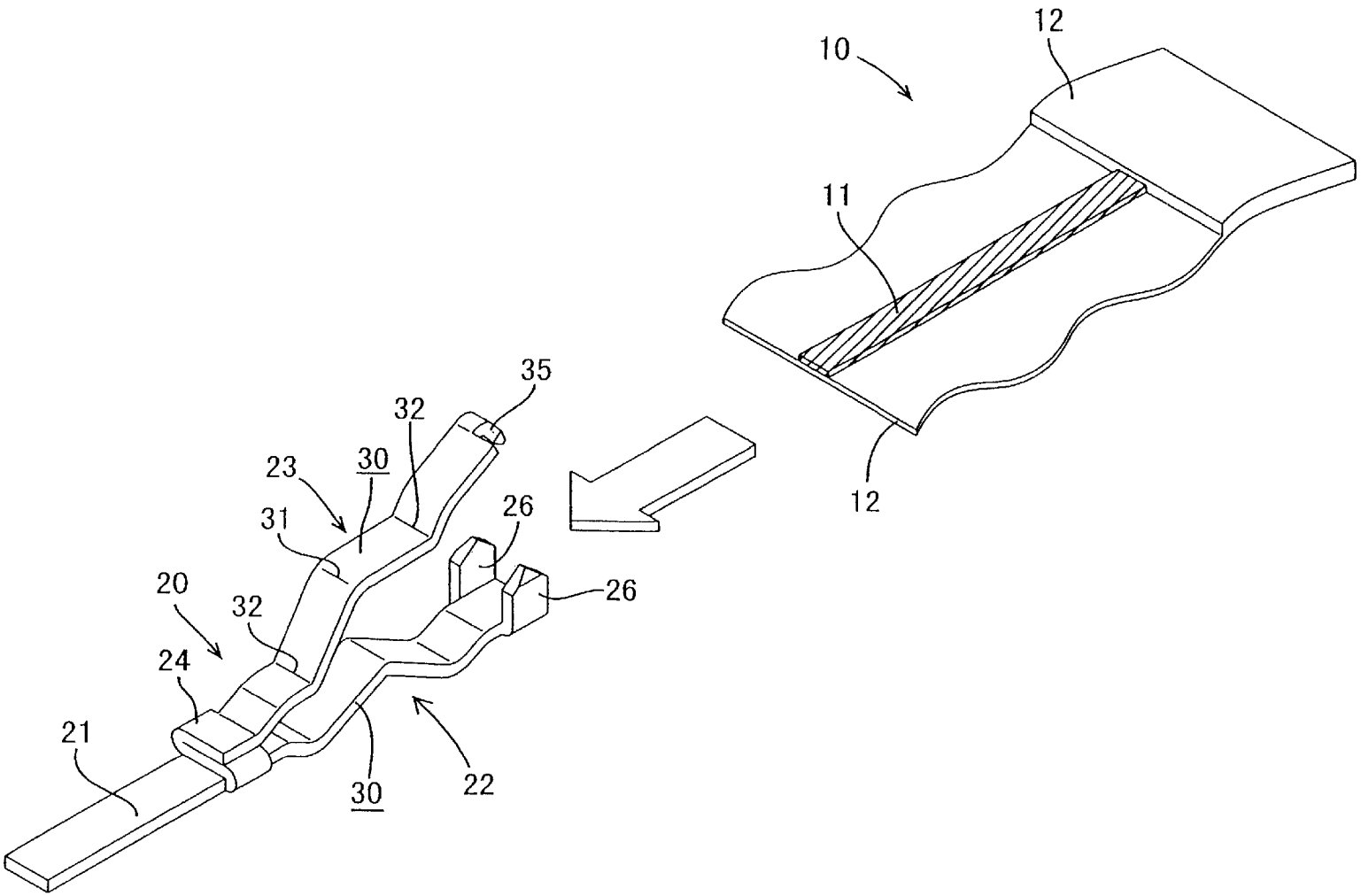
FIG. 1 is a perspective view showing a terminal fitting of a first embodiment of the present invention and an FFC not connected thereto.

Referring to FIG. 1, an FFC (flexible flat cable) is identified by the numeral 10, and is shown as an example of a flat conductor. The FFC 10 is flexible and ribbon-shaped, and includes a plurality of conductive paths 11 arranged in parallel with one another at predetermined intervals. The conductive paths 11 are embedded in insulation sheets 12 disposed on upper and lower surfaces of the conductive paths 11. The upper side of the insulation sheet 12 is torn off in a predetermined range of the FFC 10. Thus, the conductive paths 11 are exposed on the upper side of the FFC 10. In other embodiments, the upper and lower sides of the insulation sheet 12 may be torn off.

Figure 2:
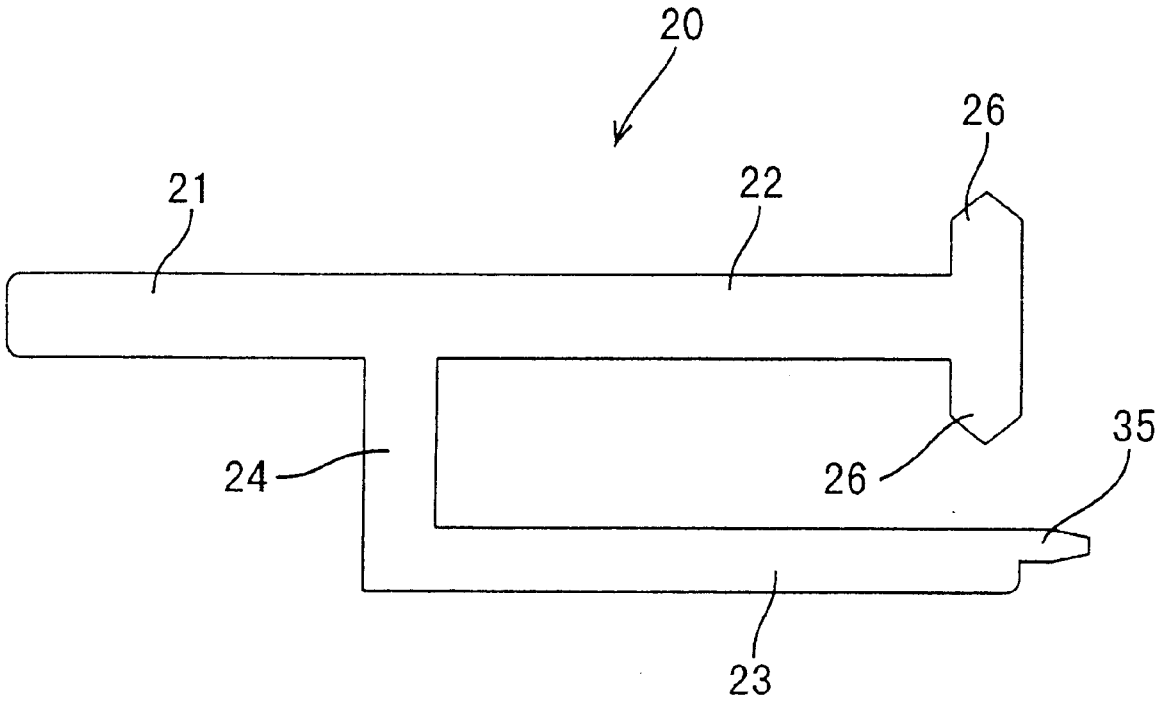
FIG. 2 is a developed view showing the terminal fitting of FIG. 1.

A terminal fitting 20 of this embodiment is formed as a male terminal fitting by press-molding a plate of highly electrically conductive metal. The terminal fitting 20 includes a tab 21 to be fitted on a mating female terminal fitting, and a bottom plate 22 extends rearward from the rear end of the tab 21. A ceiling plate 23 confronts the bottom plate 22 vertically. In the blank, as shown in FIG. 2, the ceiling plate 23 is formed in parallel with the bottom plate 22, and is joined unitarily to the bottom plate 22 by a bending part 24 that projects sideways from a base portion of the tab 21. The bending part 24 is bent twice in close contact with the tab 21. The ceiling plate 23 confronts the bottom plate 22 and is integral with the ceiling plate 23 such that the rear end (right in FIG. 1) of the ceiling plate 23 can be opened and closed.

The length of the region in which the bottom plate 22 confronts the ceiling plate 23 and which can be opened and closed is almost equal to the length of the exposed portion of the conductive path 11. The width of the bottom plate 22 and the width of the ceiling plate 23 are set a little larger than the width of the conductive path 11. A crimping blade 26 is erected on each side edge of the bottom plate 22 adjacent the rear end of the bottom plate 22. The upper end of each of the crimping blades 26 is sharp.

Wavy parts or undulations 30 are formed in positions substantially centrally along the length of each of the bottom plate 22 and the ceiling plate 23. Each wavy part 30 has a peak 31, and two valleys 32 are formed at the opposite respective longitudinal ends of the peak 31. Each wavy part or undulation 30 is so formed that it can contact the FFC 10 closely when the terminal of the FFC 10 is sandwiched between the bottom plate 22 and the ceiling plate 23.

A piercing piece 35 that can be inserted into the FFC 10 is formed at the rear end of the ceiling plate 23 in about the half of the entire width of the rear end thereof. The lower end of the piercing piece 35 is sharp and bent downward perpendicularly toward the bottom plate 22.

The procedure of connecting the terminal fitting to the FFC in the first embodiment is described below.

Figure 3:
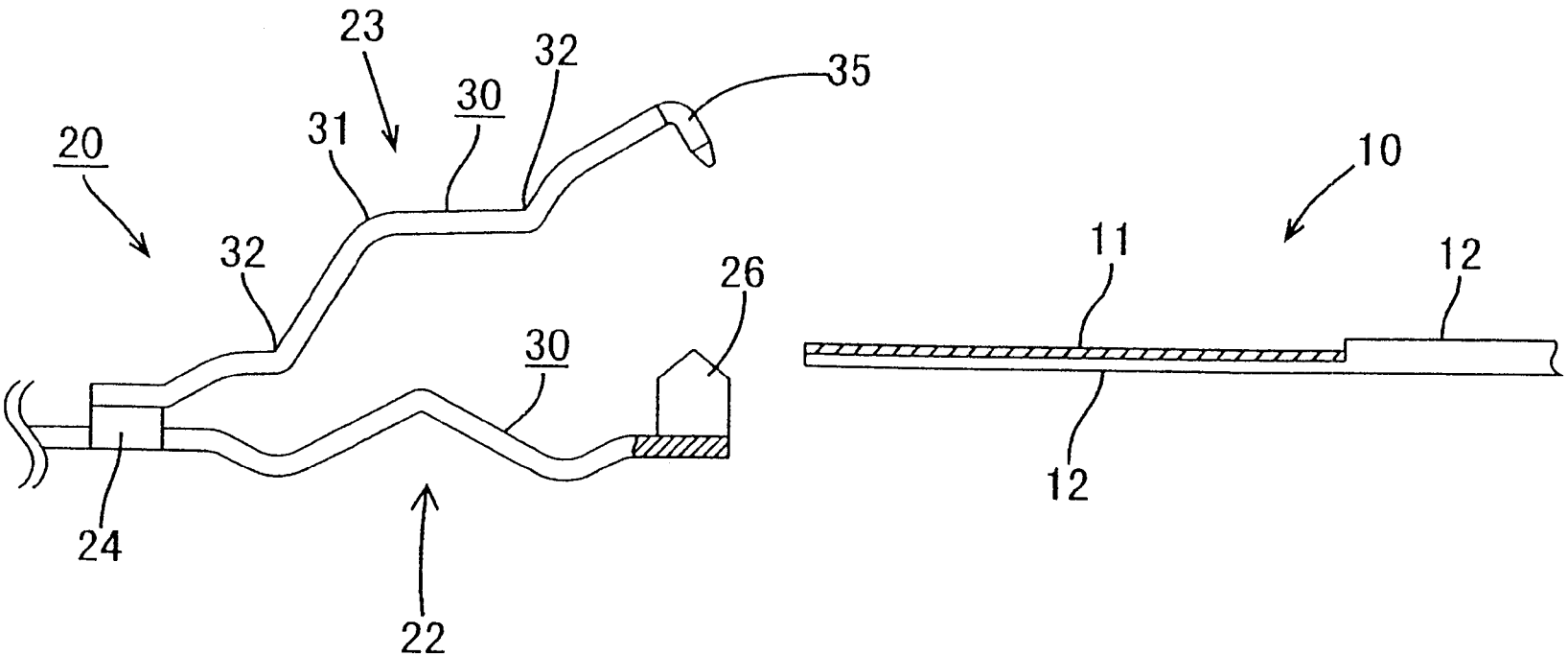
FIG. 3 is a partly cutout side view showing the terminal fitting and the FFC not connected thereto.

As shown in FIGS. 1 and 3, the ceiling plate 23 of the terminal fitting 20 is opened upward, and the terminal of the FFC 10 is inserted between the bottom plate 22 and the ceiling plate 23 by adjusting the mating position of the conductive path 11 to the location of the terminal fitting 20. The ceiling plate 23 then is pivoted toward the bottom plate 22, such that both crimping blades 26 on the bottom plate 22 are pierced into the insulation sheet 12 at the left and right sides of the conductive path 11 and project from the upper surface of the terminal of the FFC 10. Thus, the upper and lower surfaces of the FFC 10 are sandwiched and pressed between the bottom plate 22 and the ceiling plate 23. Accordingly, the disposing portion of the conductive path 11 is flexed in the shape of wave and sandwiched therebetween. At this time, the piercing piece 35 at the rear end of the ceiling plate 23 penetrates through the conductive path 11 of the FFC 10 at a location where both the upper and lower surfaces of the FFC 10 are covered with the insulation sheet 12. The piercing piece then projects from the lower surface of the FFC 10.

Figure 4:
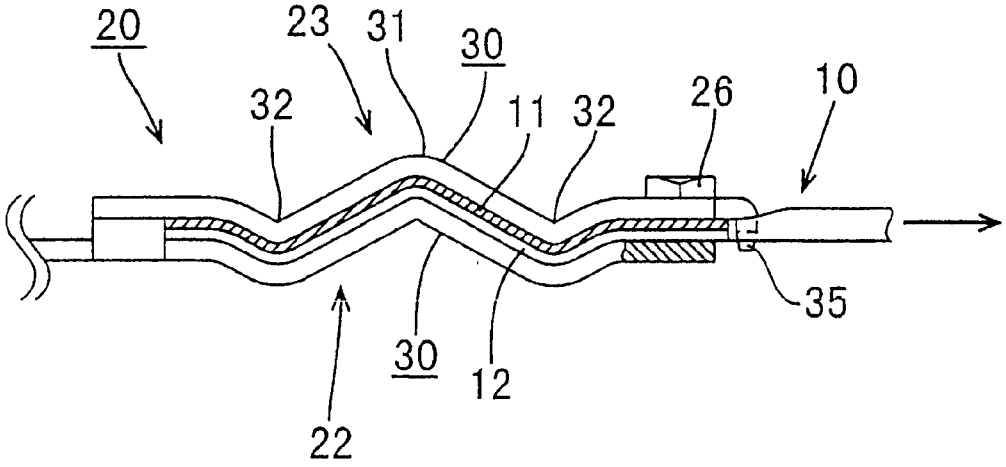
FIG. 4 is a partly cutout side view showing the terminal fitting and the FFC connected thereto.
Figure 5:
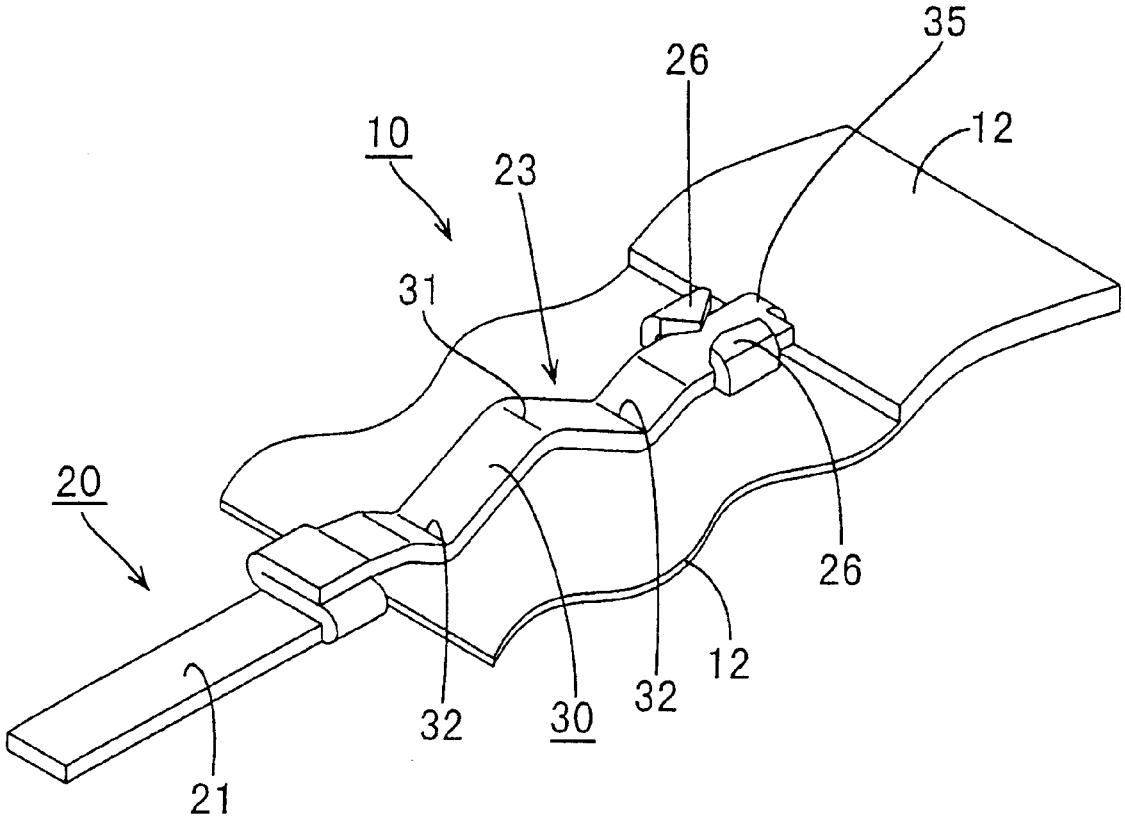
FIG. 5 is a perspective view showing the terminal fitting and the FFC connected thereto.

At the final stage, the crimping blades 26 are bent inward and crimped to the rear end of each of the left and right side edges of the ceiling plate 23. As a result, as shown in FIGS. 4 and 5, the bottom plate 22 and the ceiling plate 23 are connected to each other in a closed state, with the bottom plate 22 and the ceiling plate 23 sandwiching the disposing portion of the conductive path 11.

In the first embodiment, the disposing portion of the conductive path 11 is sandwiched between the wavy part 30 formed on bottom plate 22 and the wavy part 30 formed on ceiling plate 23. Thus, the disposing portion of the conductive path 11 is bent wavily. In other words, because the bent ceiling plate 23 contacts the conductive path 11 closely, it is possible to obtain a high contact pressure and a stable electric performance.

The FFC 10 is used with the terminal fitting 20 connected to the terminal of the FFC 10 and accommodated in a cavity of a connector housing (not shown). As shown with an arrow of FIG. 4, a tensile force may be applied rearward to the FFC 10. In the first embodiment, the ceiling plate 23 and the bottom plate 22 bend the FFC 10 wavily and contact the FFC 10 closely. Further, the piercing piece 35 has a width in a direction perpendicular to the direction in which the tensile force is applied to the FFC 10, and is pierced into the conductive path 11. Thus, the piercing piece 35 catches the terminal fitting 20 firmly in resistance to the tensile force. Therefore, the terminal fitting 20 is not easily removed from the terminal of the FFC 10.

The piercing piece 35 catches the terminal fitting 20 at a position forward from the position in which the terminal fitting 20 is connected to the terminal of the FFC 10. Thus, it is possible to effectively prevent the tensile force from acting on the contact portion and protect the contact surface. Therefore, it is possible to increase electrical reliability.

The piercing piece 35 can be formed easily by bending the rear end of the ceiling plate 23. The piercing piece 35 then is inserted into the conductive path 11, thus increasing the contact area.

The second embodiment of the present invention will be described below with reference to FIGS. 6 through 11. In the second embodiment, the present invention is applied to a terminal fitting of through type.

Figure 6:
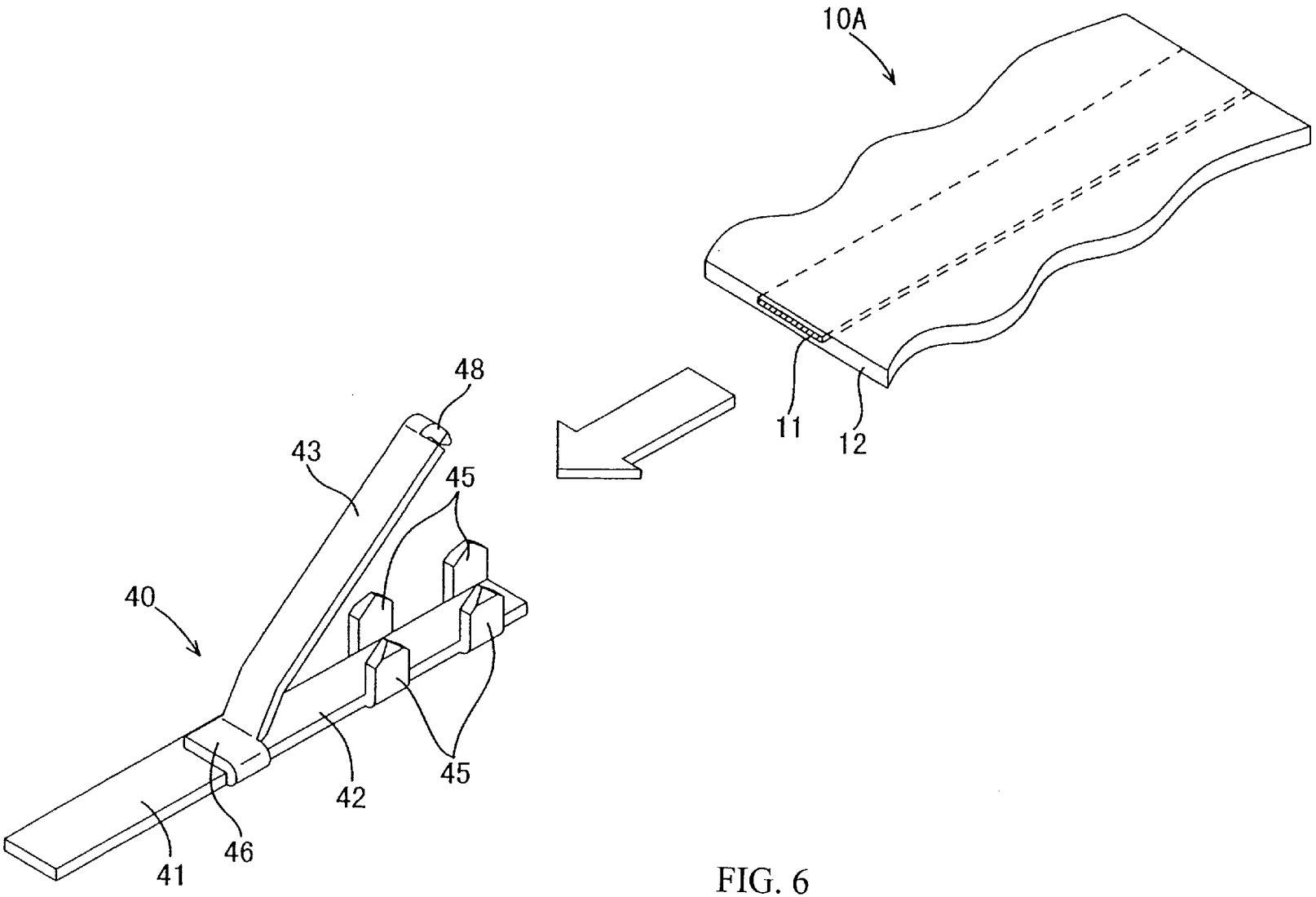
FIG. 6 is a perspective view showing a terminal fitting of a second embodiment of the present invention not connected to the FFC.

Referring to FIG. 6, reference numeral 10 denotes an FFC similar to the FFC exemplified in the first embodiment. The FFC 10 is flexible and ribbon-shaped, and has a plurality of parallel conductive paths 11 arranged at predetermined intervals. The conductive paths 11 are embedded in insulation sheets 12 disposed on upper and lower surfaces of the conductive paths 11. The second embodiment is different from the first embodiment in that the insulation sheet 12 is not torn off.

Figure 7:
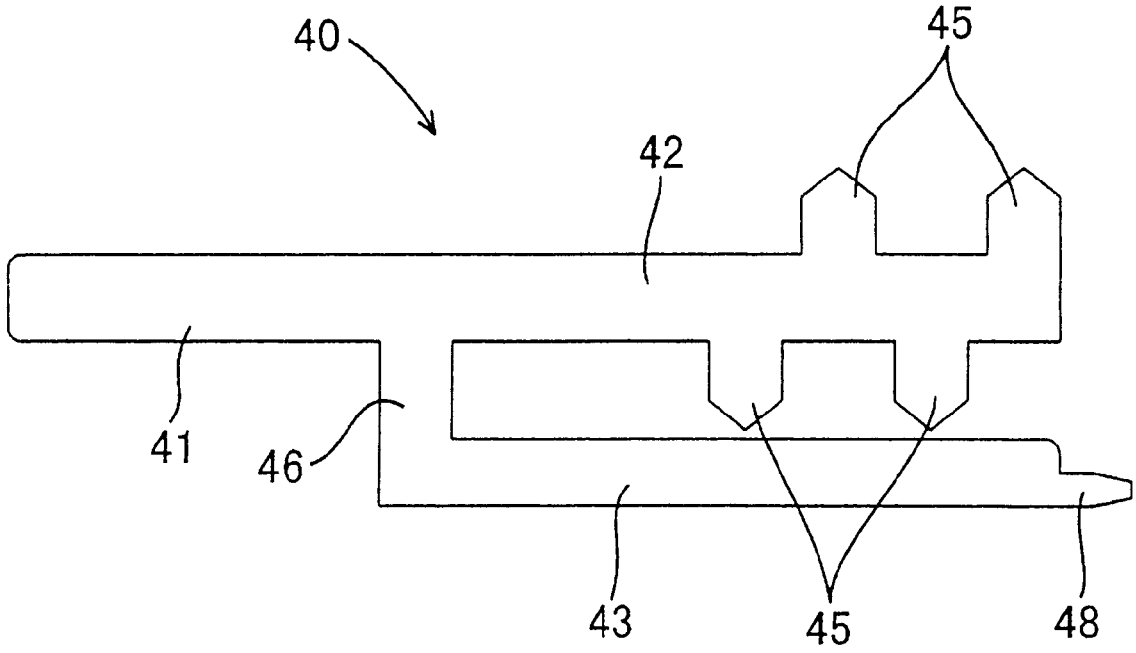
FIG. 7 is a developed view showing the terminal fitting of FIG. 6.

A terminal fitting 40 of the second embodiment is a male terminal fitting that is formed by press-molding a plate of highly electrically conductive metal. The terminal fitting 40 includes a tab 41 to be fitted on a mating terminal fitting. Additionally, as shown in FIG. 7, a bottom plate 42 extends rearward from the rear end of a tab 41, and a ceiling plate 43 confronts the bottom plate 42 vertically. As shown in FIG. 2, the blank for forming the terminal fitting initially has the ceiling plate 43 parallel with the bottom plate 42 and unitarily joined to the bottom plate 42 by a bending part 46 that projects sideways from a base portion of the tab 41. The bending part 24 is bent twice to lie in close contact with the tab 41. The ceiling plate 43 confronts the bottom plate 42 and is integral with the ceiling plate 43 such that the rear end (right in FIG. 1) of the ceiling plate 43 can be opened and closed.

The bottom plate 42 is slightly narrower than the conductive path 11 and has two contact blades 45 formed respectively at left and right side edges of the bottom plate 42. The contact blades 45 are erected on the bottom plate 42 such that they alternate with one another along the length of the bottom plate 42. The upper end of each contact blade 45 is tapered to a point. The ceiling plate 43 can penetrate into the space between the contact blades 45.

A piercing piece 48 is formed at the rear end of the ceiling plate 43 in about the half of the entire width of the rear end thereof. The lower end of the piercing piece 48 is sharp and bent down perpendicularly toward the bottom plate 42. Thus the piercing piece 48 can be inserted into the FFC 10.

The procedure of connecting the terminal fitting to the FFC in the second embodiment is described below.

Figure 8:
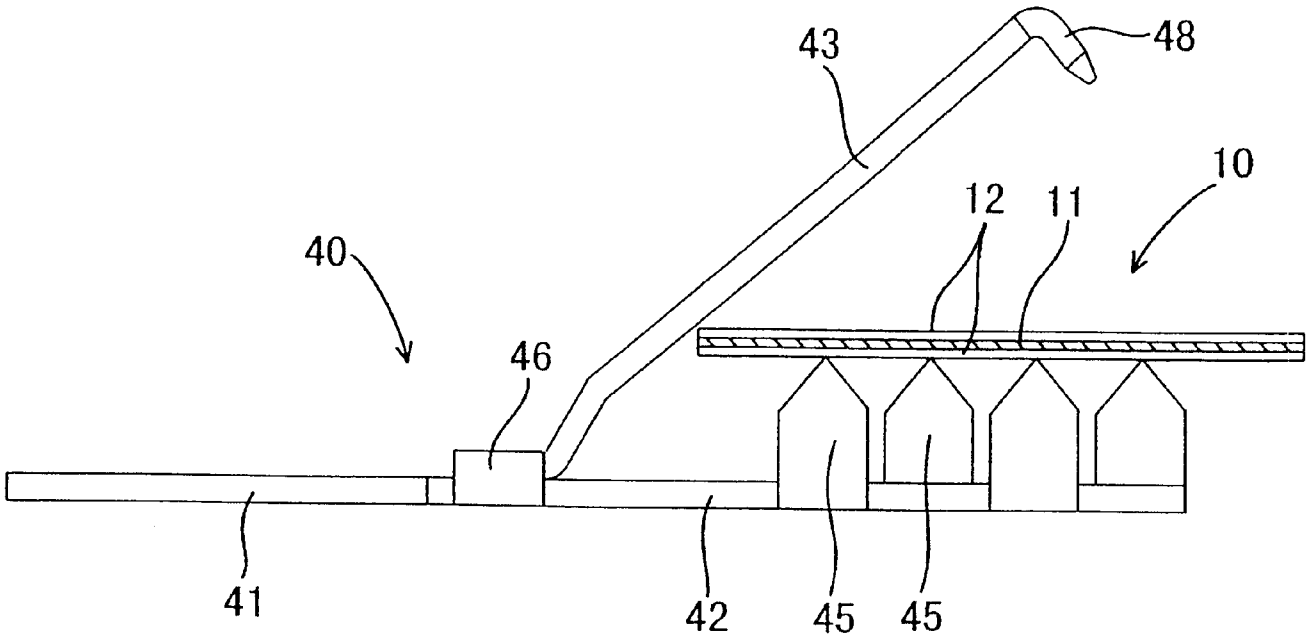
FIG. 8 is a partly cutout side view showing the terminal fitting and the FFC not connected thereto.
Figure 9:
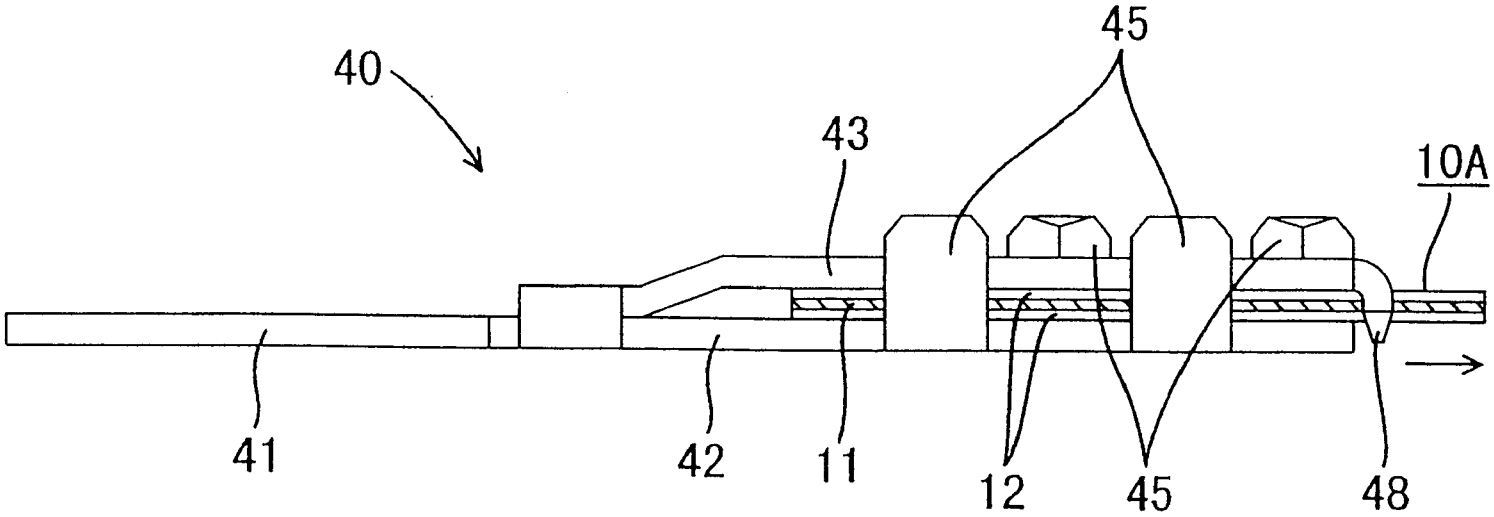
FIG. 9 is a partly cutout side view showing the terminal fitting and the FFC connected thereto.
Figure 10:
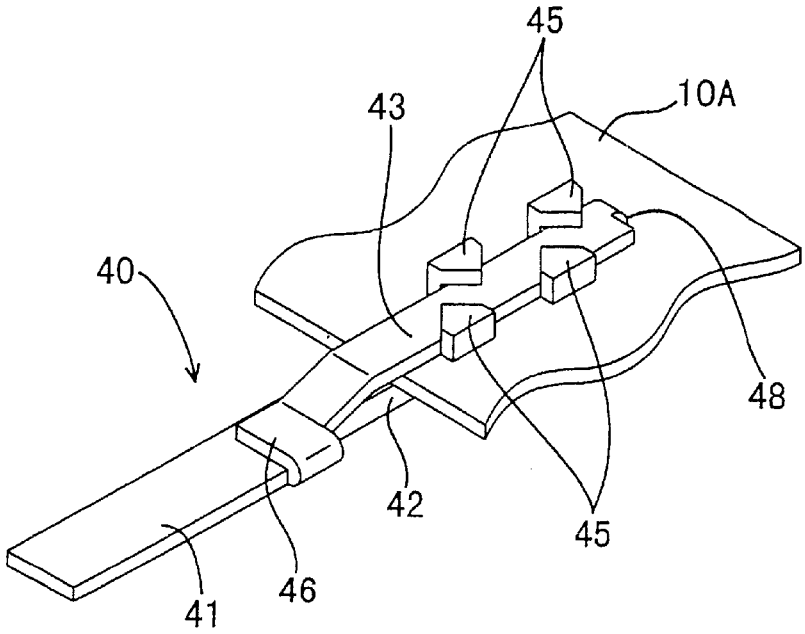
FIG. 10 is a perspective view showing the terminal fitting and the FFC connected thereto.

As shown in FIGS. 6 and 8, the ceiling plate 43 of the terminal fitting 40 is opened upward, and the terminal of the FFC 10 is inserted between the bottom plate 42 and the ceiling plate 43 by adjusting the mating position of the conductive path 11 to the location of the terminal fitting 40. The ceiling plate 43 then is pivoted toward the bottom plate 42, and the contact blades 45 at the left and right side edges of the bottom plate 42 pierce through the conductive path 11 at positions located slightly inward from the left and right side edges of conductive path 11. Then, ceiling plate 43 is closed to press the terminal of the FFC 10 against the bottom plate 42. At this time, the piercing piece 48 formed at the rear end of the ceiling plate 23 penetrates through the disposing position of the conductive path 11 of the FFC 10 and projects from the lower surface thereof. At the final stage, the contact blades 45 are crimped to the left and right side edges of the ceiling plate 43, with the projected upper end thereof bent inward. As a result, as shown in FIGS. 9 and 10, the bottom plate 42 and the ceiling plate 43 are connected to each other in a closed state.

Figure 11:
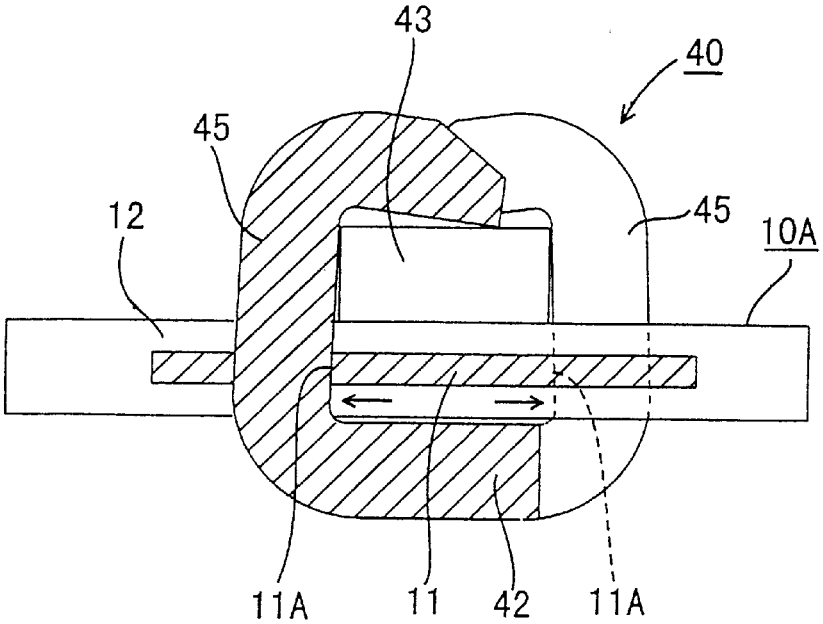
FIG. 11 is an enlarged cross-sectional view showing the terminal fitting and the FFC connected thereto.
Figure 12:
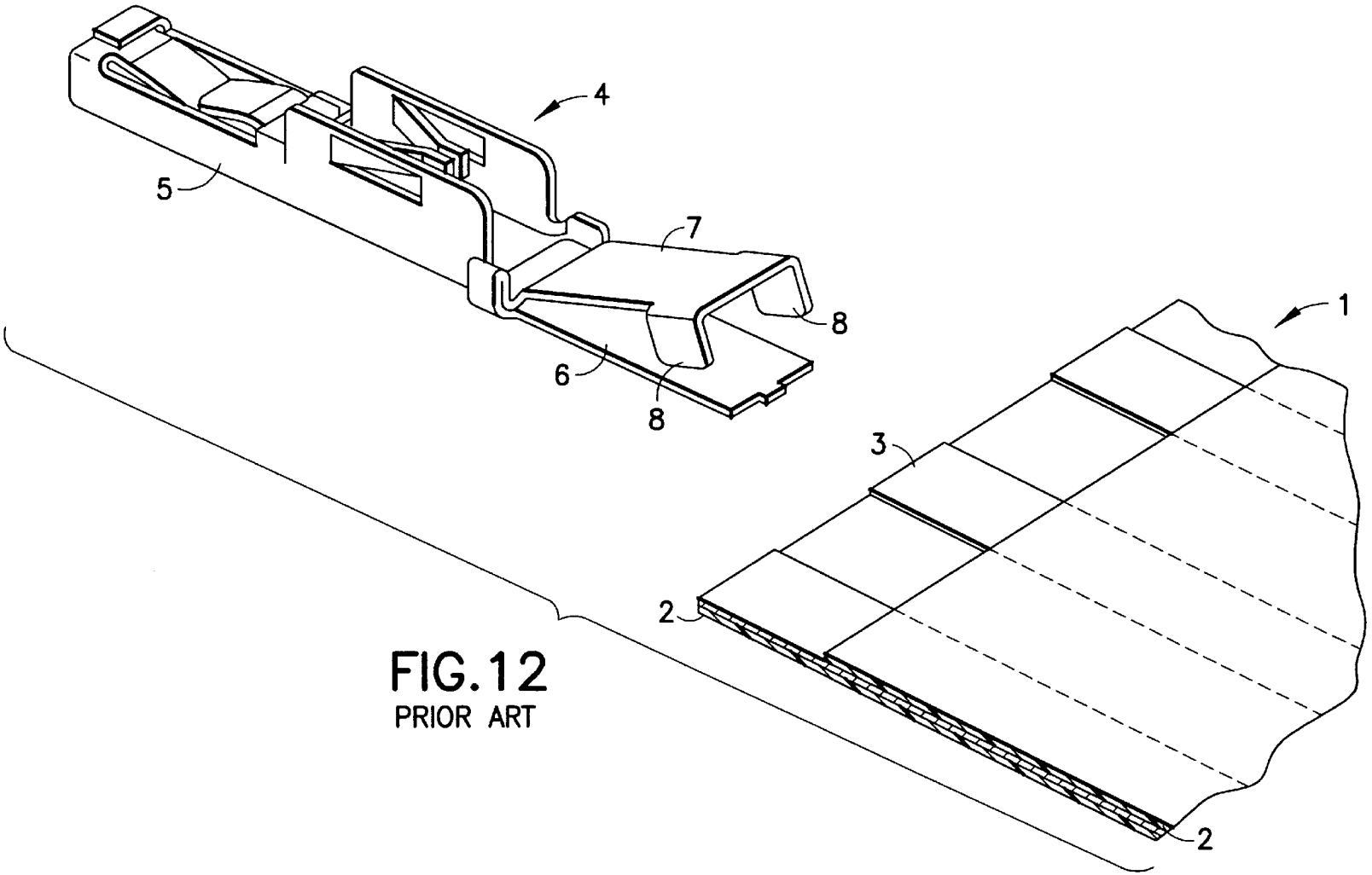
FIG. 12 PRIOR ART
FIG. 12 is a sectional view showing an example of the conventional art.

In the second embodiment, after the contact blades 45 are pierced into the conductive path 11, the ceiling plate 43 presses the FFC 10 against the bottom plate 42. Thus, as shown in FIG. 11, the FFC 10 interposed between the confronting contact blades 45 is allowed to be straight, horizontal and compressed vertically. Consequently, both cut surfaces 11A of the conductive path 11 interposed between the confronting contact blades 45 project widthwise and contact the inner surfaces of the contact blades 45 at a high pressure. Thus, it is possible to obtain a stable electric performance.

The ceiling plate 43 keeps pressing the conductive path 11 against the bottom plate 42 and keeps the conductive path 11 in a compressed state.

The FFC 10 is used, with the terminal fitting 40 connected with the terminal of the FFC 10 and accommodated in a cavity of a connector housing (not shown). As shown with an arrow of FIG. 9, a tensile force may be applied to the FFC 10 in a rearward direction. The contact blades 45 are pierced into the FFC 10, with the contact blades 45 aligned parallel with the direction of the applied tensile force. Thus, there is a fear that the tensile force may cause the terminal fitting 40 to tear off from the FFC 10 and be removed therefrom, and hence there is a fear that electrical performance of the contact surface is not reliable.

In the second embodiment, the piercing piece 48 formed at the rear end of the ceiling plate 43 is pierced into the FFC 10 in a direction perpendicular to the direction of the applied tensile force, thus the piercing piece 48 catches the terminal fitting 40 firmly in resistance to the tensile force. Therefore, the terminal fitting 40 is not easily removed from the terminal of the FFC 10.

The piercing piece 48 catches the terminal fitting 40 at a position forward from the position in which the terminal fitting 40 is connected to the terminal of the FFC 10. Thus, it is possible to effectively prevent the tensile force from acting on the contact portion and to protect the contact surface. Therefore, it is possible to increase electrical reliability.

The piercing piece 48 can be formed easily by bending the rear end of the ceiling plate 43. The piercing piece 48 is inserted into the conductive path 11, thus increasing the contact area.

The present invention is not limited to the embodiment described above with reference to the drawings. For example, the following embodiments are included in the technical scope of the present invention. Further, various modifications can be made without departing from the spirit and scope of the present invention.

In the illustrated embodiments, the ceiling plate is connected to the bottom plate. However the ceiling plate may be formed separately from the bottom plate.

It is possible to connect the terminal fitting to the FFC by turning the bottom plate and the ceiling plate upside down.

The piercing piece may be formed on both the ceiling plate and the bottom plate in such a manner that both piercing pieces do not interfere with each other. Alternatively, the piercing piece may be formed on only the bottom plate.

In the first embodiment, the bottom plate and the ceiling plate may be flat, and a holding force is obtained by inserting the piercing piece into the FFC. Thus, the piercing piece is included in the technical scope of the present invention.

In the first embodiment, the crimping blade may be formed on the ceiling plate.

In the first embodiment, the conductive path may be wider than the bottom plate and the ceiling plate.

In the second embodiment, the contact blades may be formed on only one side of the bottom plate such that the contact blades penetrate through the ceiling plate. Further, the contact blade may be formed on the ceiling plate.

In the second embodiment, it is possible to penetrate the contact blade at one side edge of the bottom plate into the conductive path and crimp the contact blade at the other side thereof to the ceiling plate.

The present invention can be used to connect a female terminal fitting to the FFC.

It is possible to apply the present invention to a flat conductor such as an FPC in which the conductive path is covered with the insulation layer.

What is claimed is:

1. A terminated flat conductor comprising:

a flat conductor having a conductive path disposed in an insulation layer; and a terminal fitting comprising: an elongate base plate defining opposite front and rear ends and a longitudinal direction extending between the ends;

an elongate pressing plate defining opposite front and rear ends and a longitudinal direction extending between the ends, the front end of the pressing plate being hinged adjacent the front end of the base plate for rotation about an axis aligned perpendicular to the longitudinal directions of the base plate and the pressing plate, the pressing plate being rotatable about the axis between a first position where the pressing plate is spaced from the base plate to a second position where the pressing plate is confronting the base plate;

contact blades projecting from opposite sides of said base plate and aligned substantially parallel to the longitudinal directions of the base plate and the pressing plate and substantially perpendicular to the axis of rotation of the pressing plate relative to the base plate;

a bent piercing piece formed at the rear end of said pressing plate and being bent toward the base plate for piercing into at least one of the conductive path and the insulation layer, the piercing piece defining a plane extending substantially parallel to the axis of rotation and aligned substantially perpendicular to the longitudinal direction of the pressing plate, the piercing piece being disposed to lie rearwardly beyond the rear end of the base plate when the pressing plate is confronting the base plate; and wherein said base plate and said pressing plate are sandwiching upper and lower surfaces of a disposing position of said conductive path, such that at least one of said base plate and said pressing plate contacts said conductive path.

2. A terminated flat conductor according to claim 1, wherein said conductive path is exposed on a surface of said flat conductor; and one of said base plate and said pressing plate confronting said conductive path is pressed against said conductive path to bring said one plate into contact with said conductive path.

3. A terminal fitting according to claim 1, wherein said contact blades are pierced into said conductive path to connect said terminal fitting to said flat conductor.

4. A terminal fitting according to claim 1, wherein each of said base plate and said pressing plate has a plurality of undulations along its length, the undulations comprising at least one peak and at least one valley and being disposed such that the undulations in the respective base plate and pressing plate substantially nest with one another.

5. A terminal fitting, comprising:

an elongate bottom plate with opposed front and rear ends;

an elongate ceiling plate having opposed front and rear ends and defining a longitudinal direction extending between the ends, the front end of the ceiling plate being articulated in proximity to the front end of the end bottom plate for pivoting movement about an axis extending transverse to the longitudinal direction of the ceiling plate, such that said ceiling plate is pivotal from an open position where said rear end of said ceiling plate is spaced from the rear end of the bottom plate and a closed position where the rear end of the ceiling plate and the bottom plate are substantially adjacent, the bottom plate and the ceiling plate being provided with pointed projections, the pointed projections comprising a pair of substantially planar contact blades aligned substantially parallel to one another and substantially parallel to the longitudinal direction and extending unitarily from the bottom plate, and a substantially planar piercing piece extending unitarily from the rear end of the ceiling plate and aligned substantially perpendicular to the longitudinal direction, the piercing piece being rearward of the bottom plate when the ceiling plate is in the closed position.

6. The terminal fitting of claim 5, wherein the bottom plate and the ceiling plate each includes a plurality of undulations disposed and dimensioned to nest with one another when the ceiling plate is in the closed position.

* * * * *